US012516477B2

(12) United States Patent
Black et al.

(10) Patent No.: US 12,516,477 B2
(45) Date of Patent: Jan. 6, 2026

(54) TOOL FOR ALIGNING RAIL SEGMENTS

(71) Applicant: Caterpillar Inc., Peoria, IL (US)

(72) Inventors: Randall John Black, Vail, AZ (US); Mikkel Nielsen Beus, Sahuarita, AZ (US)

(73) Assignee: Caterpillar Inc., Peoria, IL (US)

( * ) Notice: Subject to any disclaimer, the term of this patent is extended or adjusted under 35 U.S.C. 154(b) by 521 days.

(21) Appl. No.: 18/171,403

(22) Filed: Feb. 20, 2023

(65) Prior Publication Data

US 2024/0279878 A1 Aug. 22, 2024

(51) Int. Cl.
*E01B 29/04* (2006.01)
*E01B 29/46* (2006.01)

(52) U.S. Cl.
CPC ..... *E01B 29/04* (2013.01); *E01B 29/46* (2013.01)

(58) Field of Classification Search
CPC ..... E01B 29/04; E01B 29/46
See application file for complete search history.

(56) References Cited

U.S. PATENT DOCUMENTS 3,472,174 A * 10/1969 Plasser ..... E01B 27/17 104/8
8,684,279 B1 * 4/2014 Bledsoe ..... E01B 29/16 104/2
9,696,147 B2 * 7/2017 Dokter ..... E01C 19/006
10,053,819 B2 * 8/2018 Lewis ..... E01B 29/20
10,646,733 B2 * 5/2020 Ecker ..... A62B 35/0081
2012/0031990 A1 * 2/2012 Ortiz Rivas ..... E01B 11/16 238/172
2012/0261524 A1 * 10/2012 Ortiz Rivas ..... E01B 5/18 246/456
2018/0058015 A1 * 3/2018 Lewis ..... E01B 29/46
2019/0127921 A1 * 5/2019 Coats ..... E01B 7/06
2020/0062284 A1 * 2/2020 Evans ..... B61L 23/002
(Continued)

FOREIGN PATENT DOCUMENTS

AU 2011304034 B2 * 11/2014 ..... E01B 25/24
CN 207465057 U 6/2018
(Continued)

OTHER PUBLICATIONS

Written Opinion and International Search Report for Int'l. Patent Appln. No. PCT/US2024/011954, mailed Apr. 30, 2024 (8 pgs).

*Primary Examiner* — Jason C Smith

(57) ABSTRACT

A tool for aligning a first rail segment with a second rail segment includes an elongated rigid member, a first arrangement, and a second arrangement. The member is configured to be positioned in an overlapping state with the first rail segment and the second rail segment. The first arrangement engages a first end portion of the first rail segment and is actuated to urge the first end portion towards the elongated rigid member. The second arrangement engages a second end portion of the second rail segment and is actuated to urge the second end portion towards the elongated rigid member. When each of the first end portion and the second end portion is urged towards the elongated rigid member, the first rail segment and the second rail segment adjoin and fall in alignment with each other to be connected together and form a contiguous rail portion of a rail line.

20 Claims, 10 Drawing Sheets

(56) References Cited

U.S. PATENT DOCUMENTS

| | | | | |
|---|---|---|---|---|
| 2020/0340186 | A1* | 10/2020 | Johansson | B61L 5/02 |
| 2023/0203761 | A1* | 6/2023 | Strashny | E01F 15/088 104/2 |
| 2024/0279878 | A1* | 8/2024 | Black | E01B 29/46 |
| 2024/0421752 | A1* | 12/2024 | Neal | F24S 25/61 |

FOREIGN PATENT DOCUMENTS

| | | | | |
|---|---|---|---|---|
| CN | 211136378 | U | 7/2020 | |
| DE | 20320393 | U1 | 8/2004 | |
| EP | 2206831 | A2 | 7/2010 | |
| JP | 2008050790 | A | 3/2008 | |
| WO | WO-2023007273 | A1 * | 2/2023 | B61L 23/047 |
| WO | WO-2024177750 | A1 * | 8/2024 | E01B 29/04 |

* cited by examiner

TOOL FOR ALIGNING RAIL SEGMENTS

TECHNICAL FIELD

The present disclosure relates to a tool for aligning rails segments with each other to form a rail line, e.g., at a worksite.

BACKGROUND

Various applications implemented at worksites, such as mine sites, use rail lines for the transfer of material, power, personnel, and the like. To produce a rail line (e.g., a single rail line), typically, multiple rail segments are serially connected one after the other. For enabling connections between the rail segments, adjoining rail segments of the rail line are generally required to be aligned to each other. Depending upon the type of application, some rail lines may need to be elevated above a ground level, and, in such cases, support may be provided from below or underneath each rail segment so as to elevate the rail line above the ground level. While forming or assembling rail segments at an elevation to form the rail line, as individual rail segments may be positioned above a support, end portions of those rails segments may sag or tend to curve downwards towards the ground, thus making one rail segment's alignment with an adjoining rail segment difficult.

U.S. Pat. No. 8,684,279 relates to a railroad alignment system for lifting and aligning railroad tracks during installation. The railroad alignment system generally includes a first vertical support and a second vertical support with a horizontal support extending therebetween. The vertical supports are vertically adjustable through use of a pair of adjustment members. A clamp assembly extends downwardly from the horizontal support at a position midway between the first vertical support and second vertical support. Through use of a pair of adjustment members, the clamp assembly may be closed to secure a track in place for alignment and lifting.

SUMMARY OF THE INVENTION

In one aspect, the disclosure relates to a tool for aligning a first rail segment with a second rail segment. The tool includes an elongated rigid member, a first arrangement, and a second arrangement. The elongated rigid member is configured to be positioned in an overlapping state with respect to each of the first rail segment and the second rail segment. The first arrangement is configured to engage a first end portion of the first rail segment and be actuated to urge the first end portion towards the elongated rigid member. The second arrangement is configured to engage a second end portion of the second rail segment and be actuated to urge the second end portion towards the elongated rigid member. When each of the first end portion and the second end portion is urged towards the elongated rigid member, the first rail segment and the second rail segment adjoin and fall in alignment with each other to be connected together and form a contiguous rail portion of a rail line.

In another aspect, the disclosure is directed to a method for aligning a first rail segment with a second rail segment. The method includes positioning an elongated rigid member in an overlapping state with respect to each of the first rail segment and the second rail segment; engaging a first end portion of the first rail segment by using a first arrangement and actuating the first arrangement to urge the first end portion towards the elongated rigid member; and engaging a second end portion of the second rail segment by using a second arrangement and actuating the second arrangement to urge the second end portion towards the elongated rigid member. When each of the first end portion and the second end portion is urged towards the elongated rigid member, the first rail segment and the second rail segment adjoin and fall in alignment with each other to be connected together and form a contiguous rail portion of a rail line.

DETAILED DESCRIPTION

Reference will now be made in detail to specific embodiments or features, examples of which are illustrated in the accompanying drawings. Generally, corresponding reference numbers may be used throughout the drawings to refer to the same or corresponding parts, e.g., 1, 1', 1", 101 and 201 could refer to one or more comparable components used in the same and/or different depicted embodiments.

Figure 1:
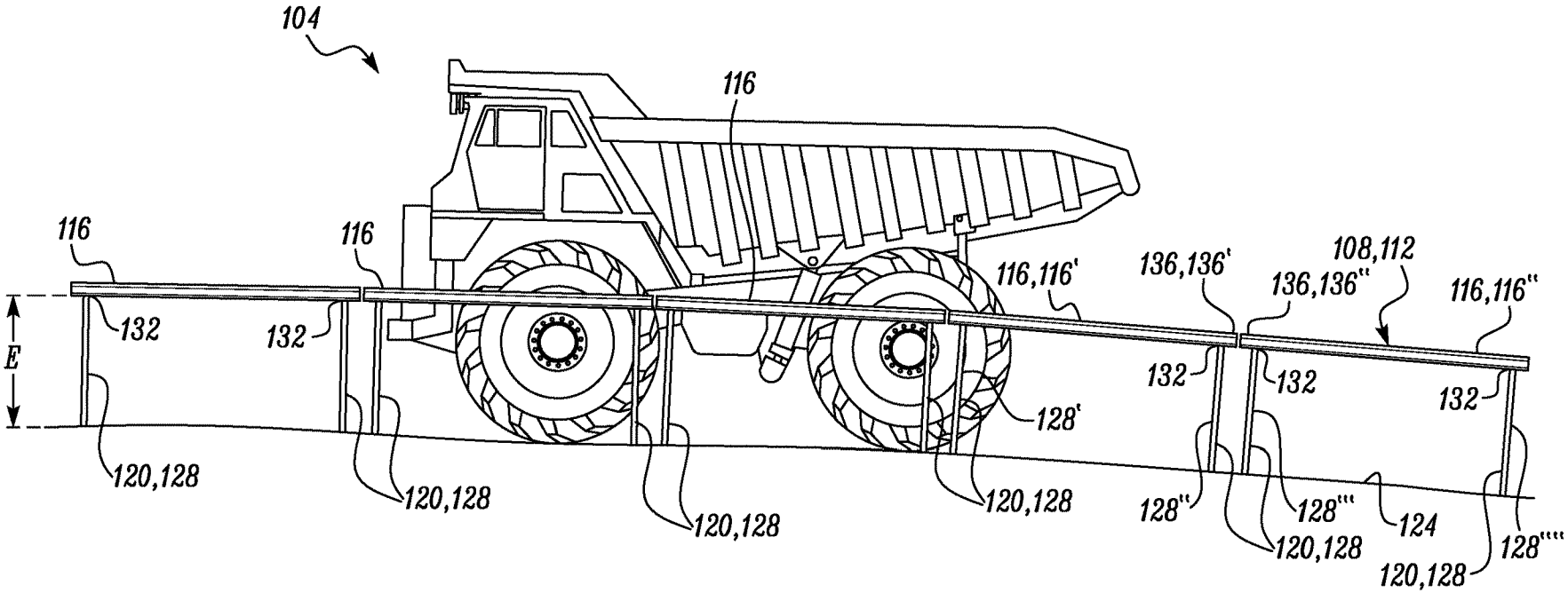
FIG. 1 is an exemplary worksite including a rail line, in accordance with one or more aspects of the present disclosure.

Referring to FIG. 1, an exemplary worksite 100 is shown. The worksite 100 may correspond to one of a mine site, a quarry, a construction site, and the like. The worksite 100 may employ a machine 104, such as a large mining truck, as shown, although there could be a variety of other machines, personnel, equipment, and the like, present at the worksite 100. The worksite 100 may include a rail line 108. The rail line 108 may be used to transfer one or more of material, personnel, equipment, and the like, between one or more locations of the worksite 100. In some embodiments, the rail line 108 may be used to supply power to various locations and/or equipment of the worksite 100 and may accordingly embody a power line 112. In some embodiments, the rail line 108 may be made or produced from a number of rail segments 116. In this regard, the rail segments 116 may be arranged and connected one after the other in a serial, lengthwise manner, as shown, to form the rail line 108. As an example, each rail segment 116 of the rail line 108 may be mounted on supports 120 standing on a ground surface 124 of the worksite 100, and, in so doing, the rail line 108 may be elevated with respect to the ground surface 124.

As part of an exemplary installation procedure of the rail line 108 at the worksite 100, multiple supports 120 and multiple rail segments 116 may be provided, as shown. Although not limited, the supports 120 may include posts 128 (e.g., vertical posts). The posts 128 may define ends (referred to as a post ends 132) (only few marked) and may be made to stand upright relative to the ground surface 124 such that the post ends 132 may be raised above and away from the ground surface 124. Also, the posts 128 may be arranged serially along a path (e.g., a predefined path) on the ground surface 124 along which the rail line 108 is to be laid. To form the rail line 108, multiple rail segments 116 may be serially mounted and arranged atop the post ends 132 such that when the rail segments 116 are joined or connected one after the other, they can cumulatively form the rail line 108. Owing to the placement of the rail segments 116 on the post ends 132 of the posts 128, the rail line 108 may be elevated (e.g., by elevation, E) with respect to the ground surface 124 of the worksite 100.

Referring to FIGS. 1 through 7, in some embodiments, each rail segment 116 is mounted onto the post ends 132 of two or more posts 128. In such a case, end portions 136 (see FIG. 4) of each rail segment 116 may extend outwards of the posts 128, causing the end portions 136 to sag or define overhangs outwardly of the post ends that curve downwards towards the ground surface 124, e.g., under the action of gravity. Such a scenario may be referred to as a 'sag state' of the corresponding rail segment 116 (see FIGS. 4 and 5). A sag state can make the alignment of one rail segment 116 difficult with respect to an adjoining rail segment 116. The forthcoming description describes a tool 150 (see FIGS. 2 and 3) and a manner of an alignment attained between two adjoining rail segments 116 of the rail line 108, e.g., a first rail segment 116' and a second rail segment 116", by use of the tool 150. It will be assumed that each of the first rail segment 116' and the second rail segment 116" may be mounted atop two corresponding posts—for example, the first rail segment 116' may be mounted atop a first post 128' and a second post 128" and the second rail segment 116" may be mounted atop a third post 128'" and a fourth post 128"" (see FIG. 1). Discussions related to the rail segments 116', 116" or to the posts 128', 128", 128'", 128"" may be equitably applicable to any rail segment 116 or to any post 128.

Referring to FIGS. 4 through 7, the first rail segment 116' and the second rail segment 116" define linear profiles, although the first rail segment 116' and the second rail segment 116" can define non-linear profiles in certain cases, such as a curve so as to be routed along a bend or turn in the path along which the rail line 108 may be laid. Further, the first rail segment 116' defines a first end portion 136' and the second rail segment 116" defines a second end portion 136". When the first rail segment 116' and the second rail segment 116" are fully aligned, end faces 154', 154" of the first end portion 136' and the second end portion 136" may face each other (see FIG. 7). The manner of alignment between the first rail segment 116' and the second rail segment 116", as described herein, can be contemplated and used for aligning each adjoining pair of rail segments 116 of the rail line 108 by use of the tool 150. The tool 150 that aligns the first rail segment 116' to the second rail segment 116" includes an elongated rigid member 158, a first arrangement 162, and a second arrangement 166.

Figure 2:
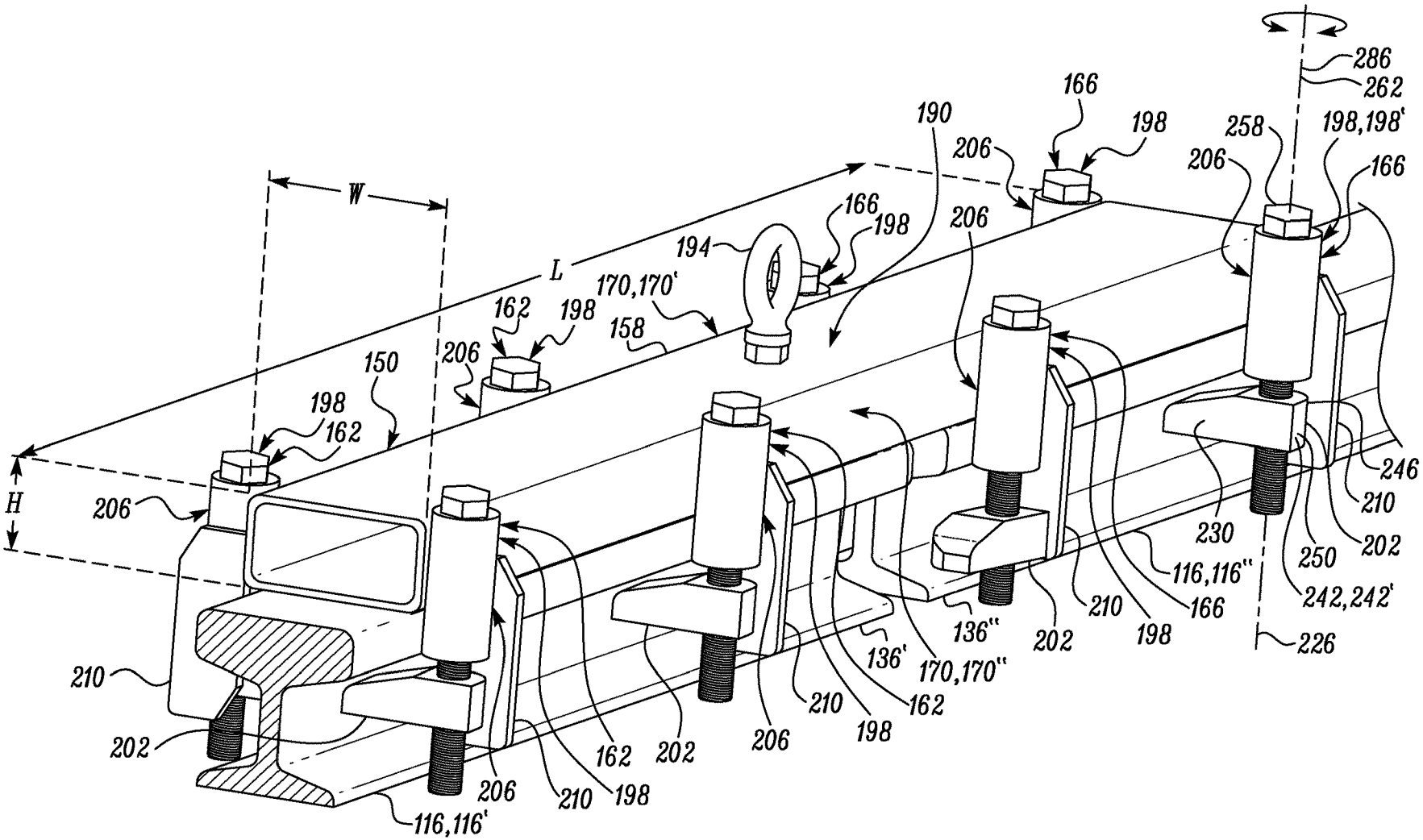
FIG. 2 is a perspective view of a tool for aligning two or more rail segments of the rail line, in accordance with one or more aspects of the present disclosure.
Figure 3:
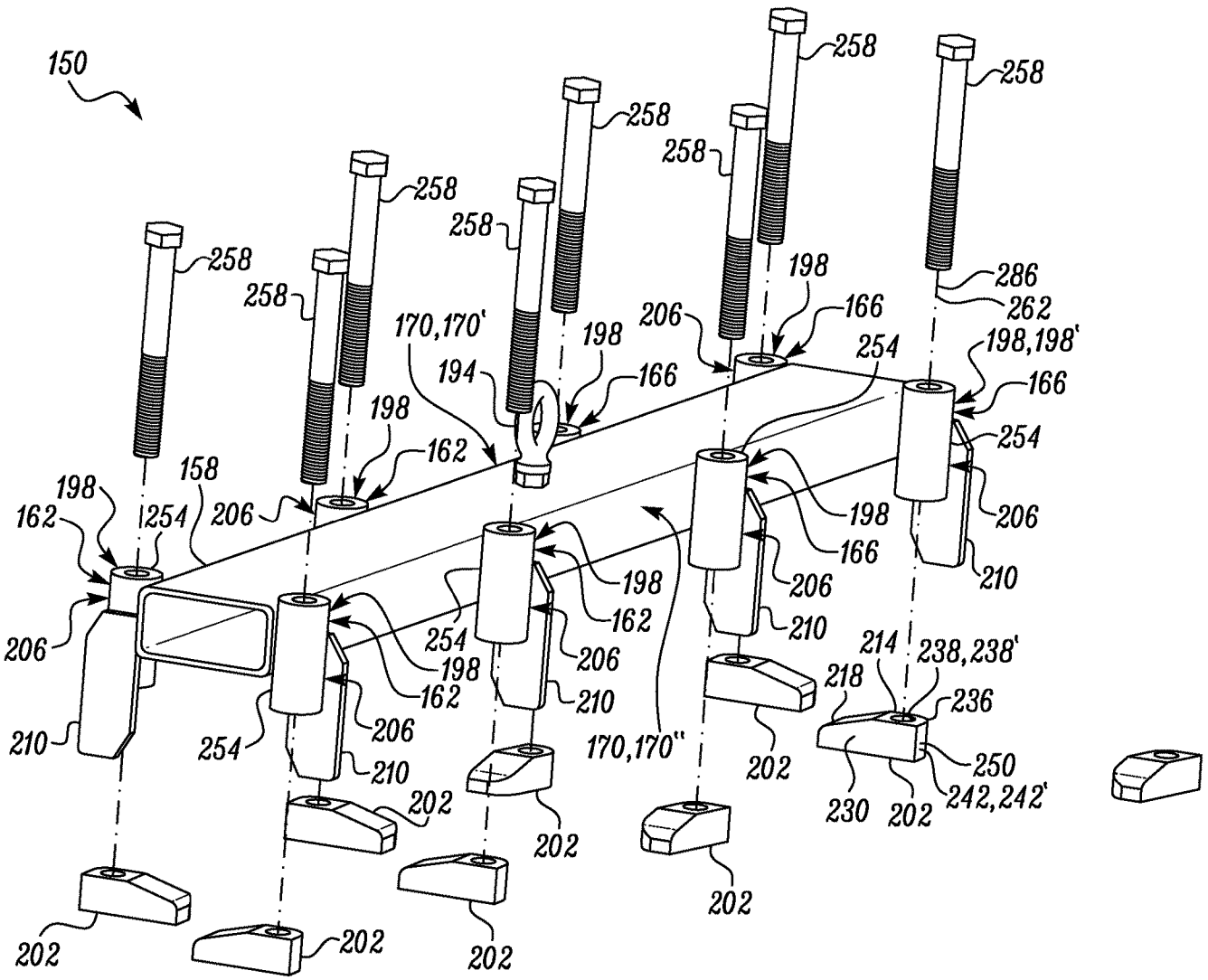
FIG. 3 is an exploded view of the tool of FIG. 2, in accordance with one or more aspects of the present disclosure.
Figure 4:
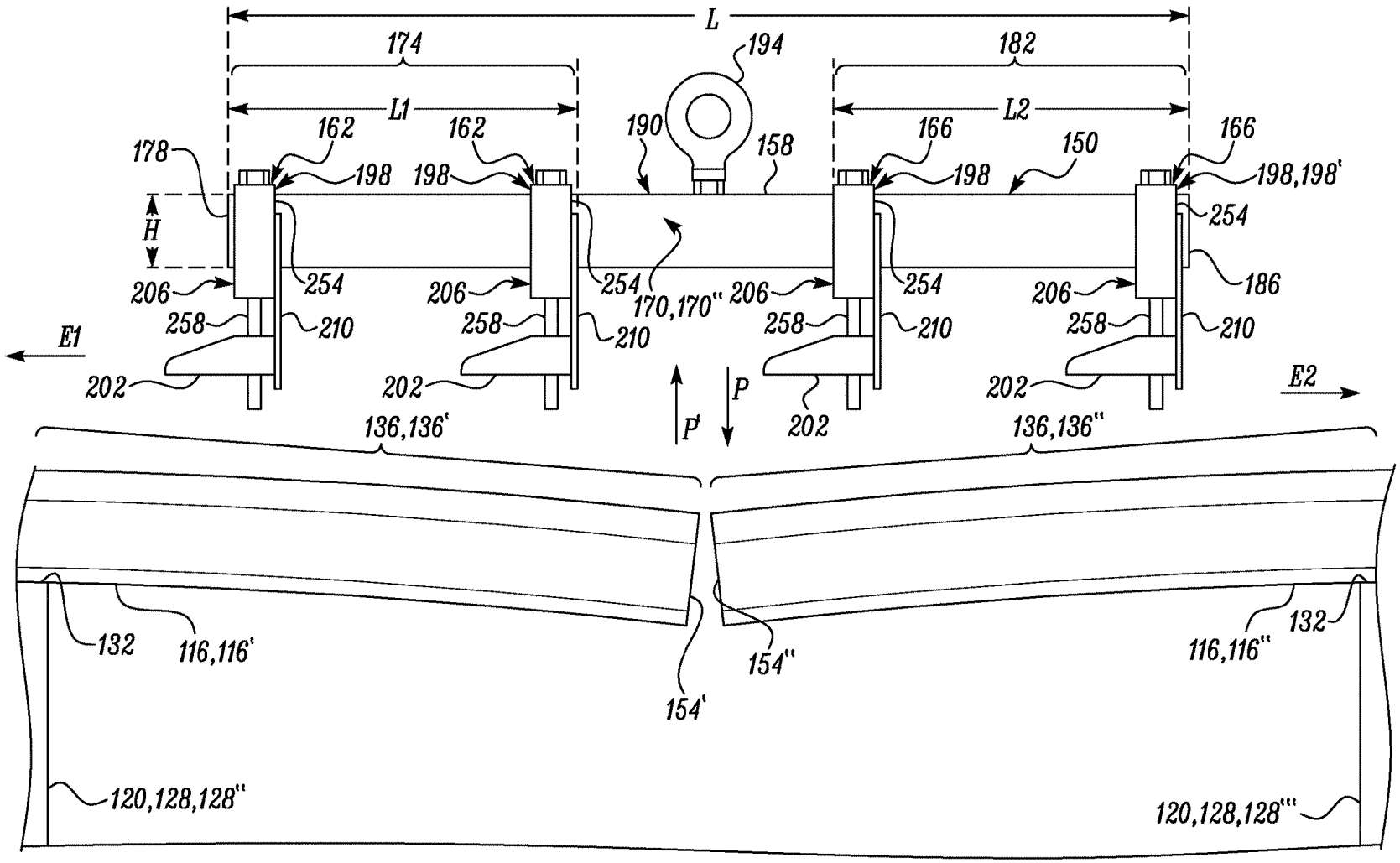
FIGS. 4 through 7 illustrate an exemplary process to align the rails segments with each other by use of the tool, in accordance with one or more aspects of the present disclosure.

Referring to FIGS. 2 and 3, and in conjunction with FIGS. 4 through 7, the elongated rigid member 158 may be configured to be positioned in an overlapping state (e.g., see FIG. 6) with respect to each of the first rail segment 116' and the second rail segment 116" during an alignment process. The alignment process may involve the alignment of the first rail segment 116' with the second rail segment 116". The elongated rigid member 158 may define a length, L, a width, W, and a height, H, and lateral sides 170 (e.g., a left side 170' and a right side 170") defined about the width, W. Although not limited, the elongated rigid member 158 may be exemplarily hollow, as shown. The elongated rigid member 158 may define a first part 174 with a first end 178 and a second part 182 with a second end 186. As shown, the second part 182 may be disposed away from the first part 174 and the second end 186 may be disposed opposite to the first end 178. The elongated rigid member 158 may also define an interface 190 between the first part 174 and the second part 182.

Figure 5:
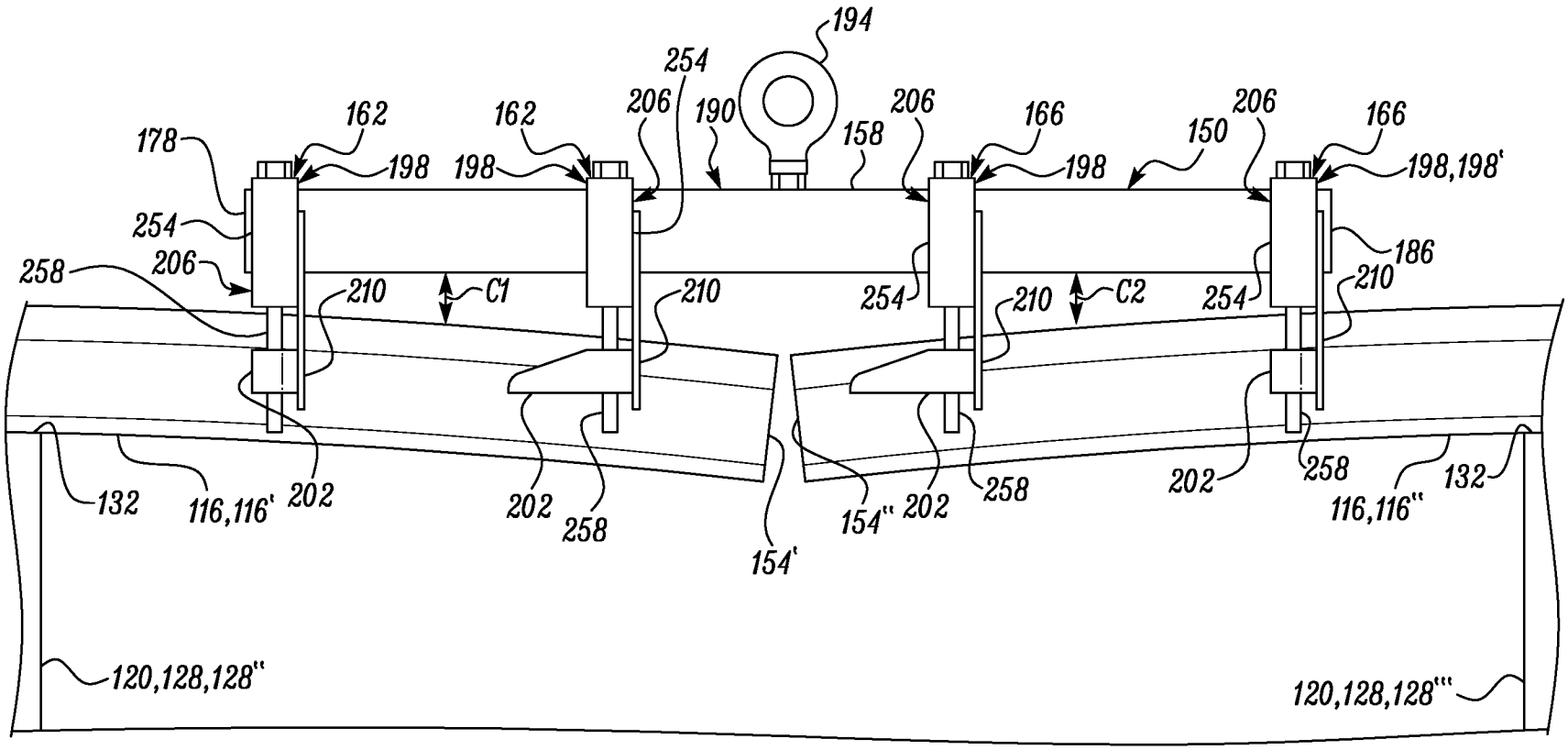
Figure 6:
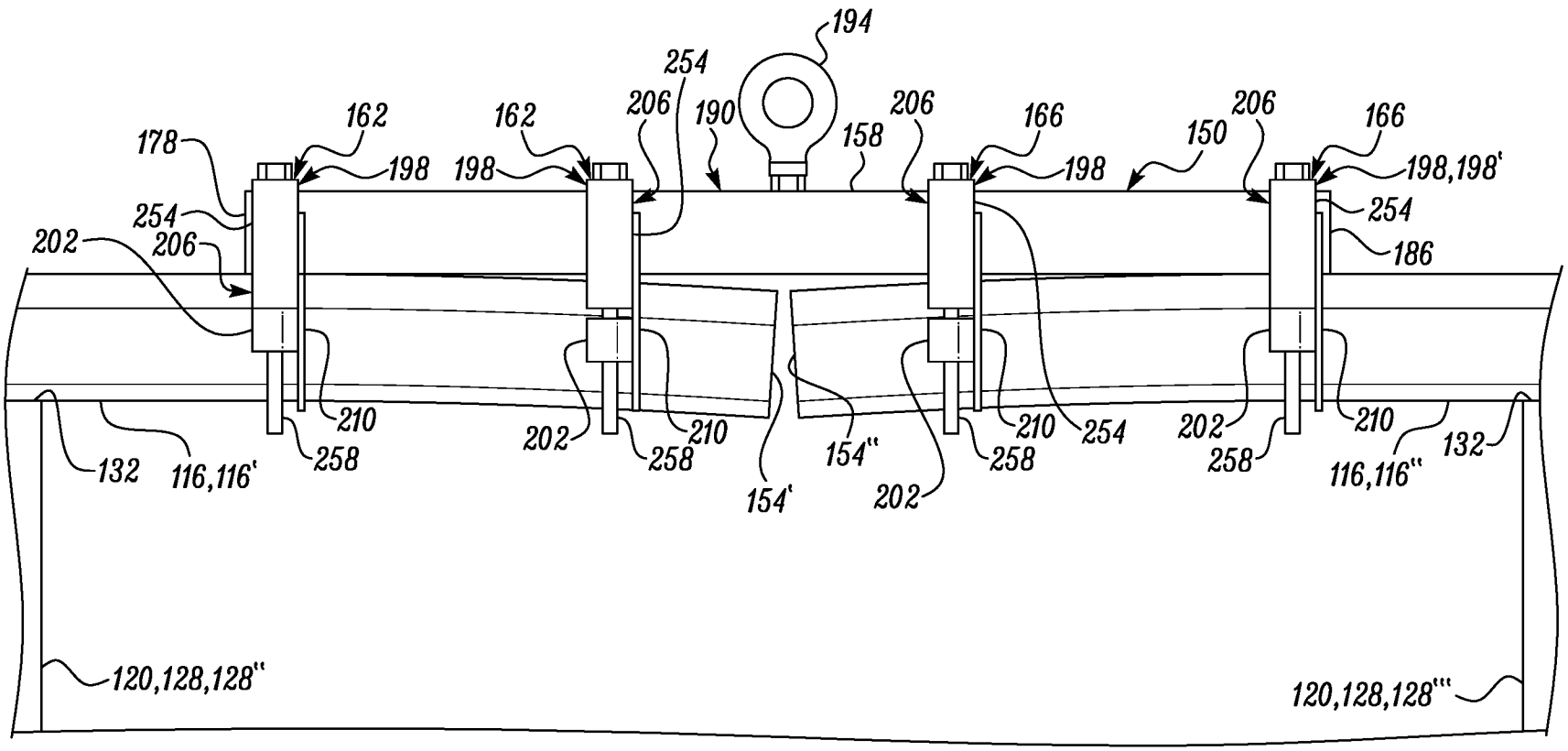
Figure 7:
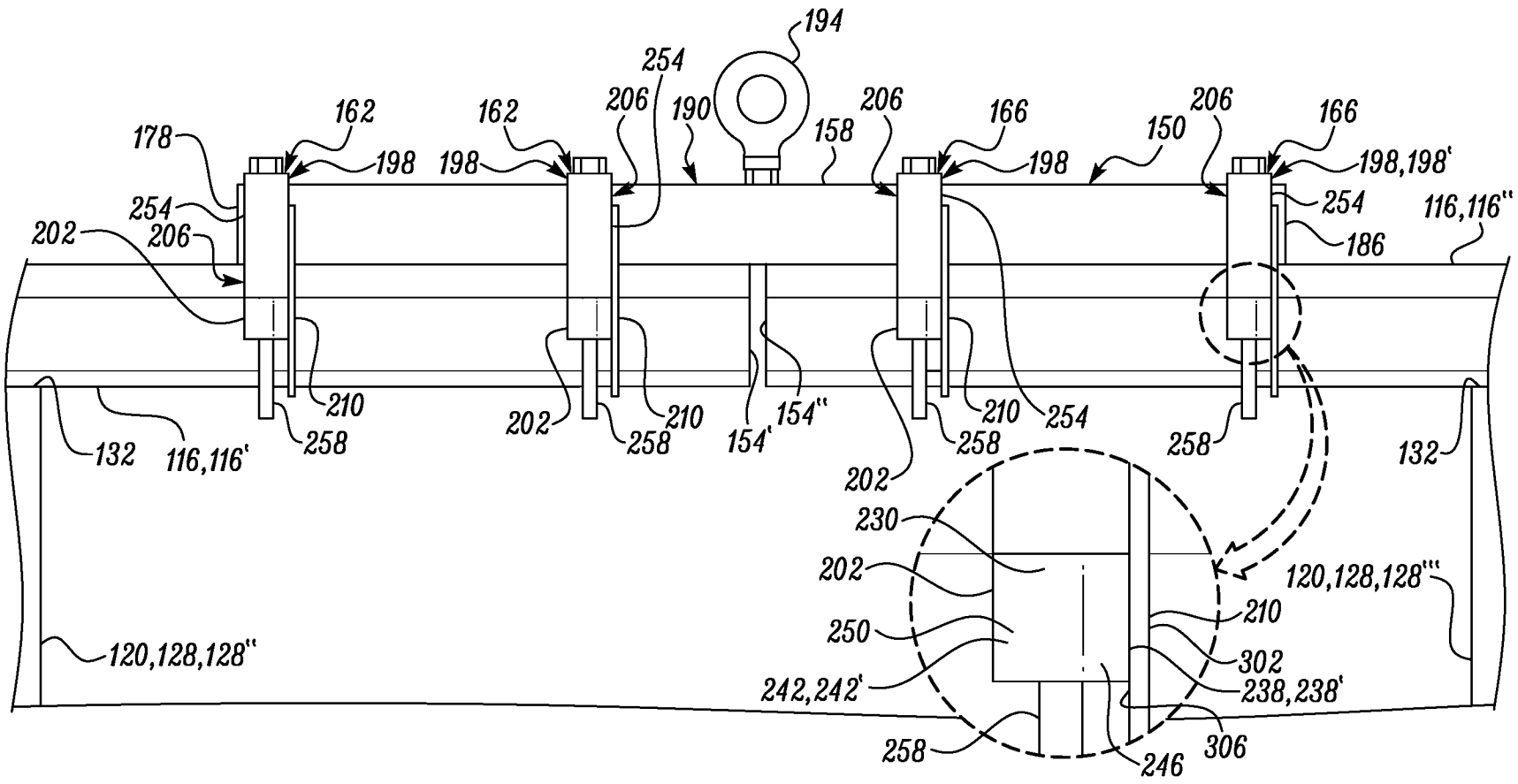

As an example, in the overlapping state and during the alignment process, the elongated rigid member 158 may overlap the first end portion 136' and the second end portion 136" of the first rail segment 116' and the second rail segment 116", respectively (e.g., see FIG. 5). In further detail, the first part 174 of the elongated rigid member 158 may overlap the first end portion 136' of the first rail segment 116' in the sag state of the first end portion 136', and the second part 182 of the elongated rigid member 158 may overlap the second end portion 136" of the second rail segment 116" in the sag state of the second end portion 136". In so doing, the elongated rigid member 158 may attain the overlapping state with respect to the first rail segment 116' and the second rail segment 116" in the sag states of the first end portion 136' and the second end portion 136". Given the sag state of the first end portion 136', a clearance, C1, (see FIG. 5) defined between the elongated rigid member 158 and the first end portion 136' may vary along a length, L1, of the first part 174. Similarly, given the sag state of the second end portion 136", a clearance, C2, (see FIG. 5) defined between the elongated rigid member 158 and the second end portion 136" may vary along a length, L2, of the second part 182. Further, the elongated rigid member 158 may include a hook 194 which may be engaged by a suitable mechanism to lift the elongated rigid member 158 (e.g., by use of a crane) (not shown) and move it to a desired location. As an example, the hook 194 may be provided on the interface 190.

The elongated rigid member 158 may include a linear profile, although, in some cases, the elongated rigid member 158 may define one or more curvatures. Such curvatures may depend upon a profile of the first end portion 136' and the second end portion 136" of the first rail segment 116' and the second rail segment 116", respectively. As an example, the first part 174 and the second part 182 of the elongated rigid member 158 may respectively follow a profile of the first rail segment 116' and the second rail segment 116" so as to be compliant with them in the overlapping state and so as to also aid in the alignment of the first rail segment 116' with the second rail segment 116" (details related to the alignment process are described later in the present disclosure). In some embodiments, it is possible that the elongated rigid member 158 is long enough to be in an overlapping state with more than two rail segments 116 so as to align each of those rail segments 116 with one another.

The first arrangement 162 and the second arrangement 166 shall now be discussed. The first arrangement 162 is configured to engage the first end portion 136' of the first rail segment 116' and be actuated to urge the first end portion 136' towards the elongated rigid member 158. Similarly, the second arrangement 166 is configured to engage the second end portion 136" of the second rail segment 116" and be actuated to urge the second end portion 136" towards the elongated rigid member 158. When each of the first end portion 136' and the second end portion 136" is urged towards the elongated rigid member 158, the first rail segment 116' and the second rail segment 116" (or their end portions 136', 136') adjoin and fall in alignment with each other to be connected together and form a contiguous rail portion of the rail line 108.

In some embodiments, the first end portion 136' and the second end portion 136" may be urged towards the elongated rigid member 158 to either be abutted to the elongated rigid member 158 or define a clearance (e.g., a common consistent clearance) with respect to the elongated rigid member 158. FIGS. 4 through 7 correspond to an exemplary alignment process in which the first end portion 136' and the second end portion 136" are urged towards the elongated rigid member 158 to be abutted with respect to the elongated rigid member 158 for attaining the alignment therebetween.

Each of the first arrangement 162 and the second arrangement 166 may include one or more clasping mechanisms 198—as an example, each of the first arrangement 162 and the second arrangement 166 includes multiple clasping mechanisms 198. However, details corresponding to only a single clasping mechanism (i.e., clasping mechanism 198') (see FIGS. 2 through 10) is primarily discussed. Said details related to the clasping mechanism 198' may be equitably applicable to all clasping mechanisms 198 of the first arrangement 162 and the second arrangement 166. In particular, some of said details of the clasping mechanism 198' may be discussed with respect to the second part 182 of the elongated rigid member 158 and/or the second end portion 136" of the second rail segment 116". Said discussions may be applicable to all clasping mechanisms 198 of the second arrangement 166, and similar and equitable discussions may also be contemplated for each of the clasping mechanisms 198 of the first arrangement 162 as well. The clasping mechanism 198' includes a foot peg 202, a shifting system 206, and a stopper 210.

Figure 8:
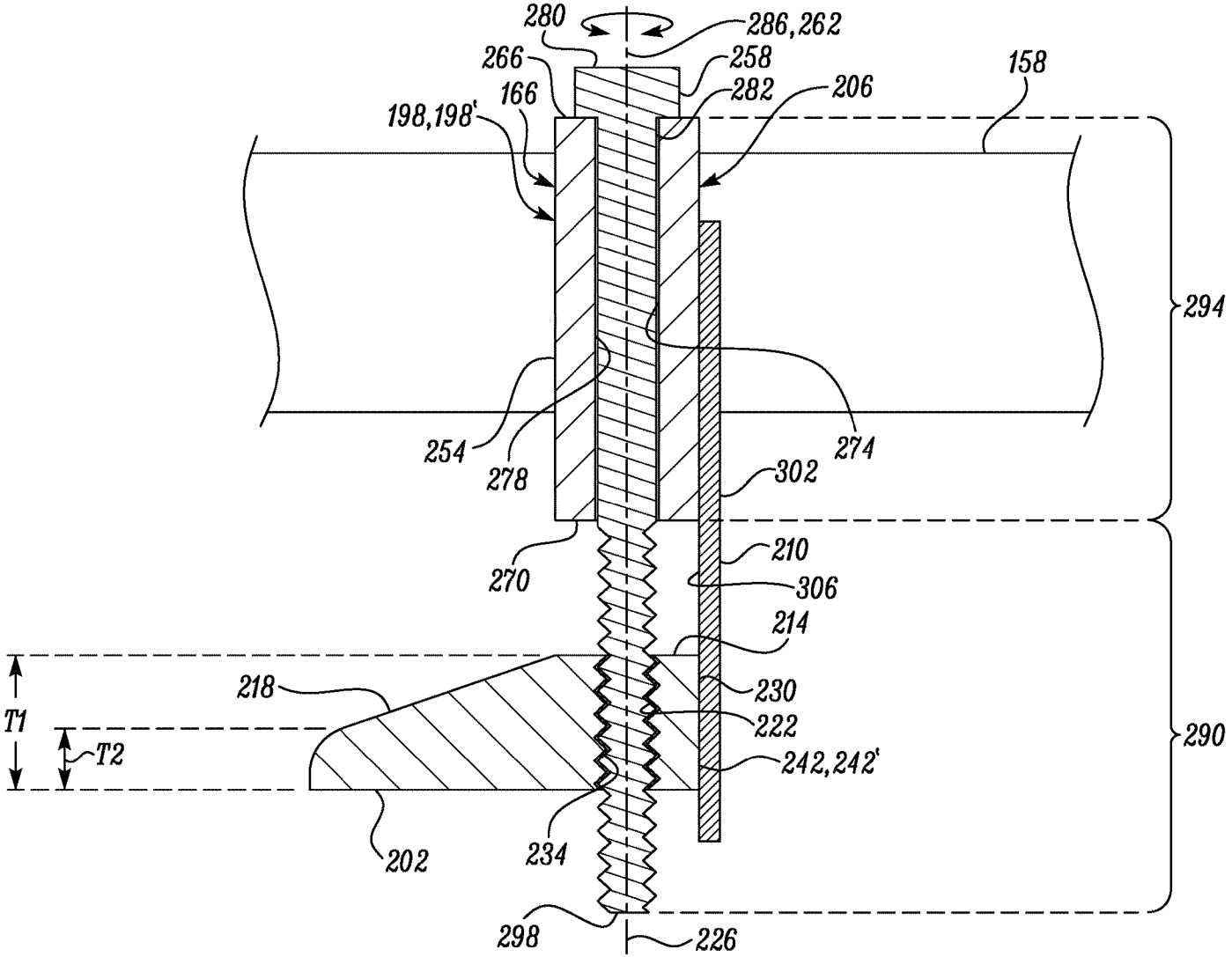
FIG. 8 is a cross-sectional view of an exemplary clasping mechanism of the tool, in accordance with one or more aspects of the present disclosure.
Figure 9:
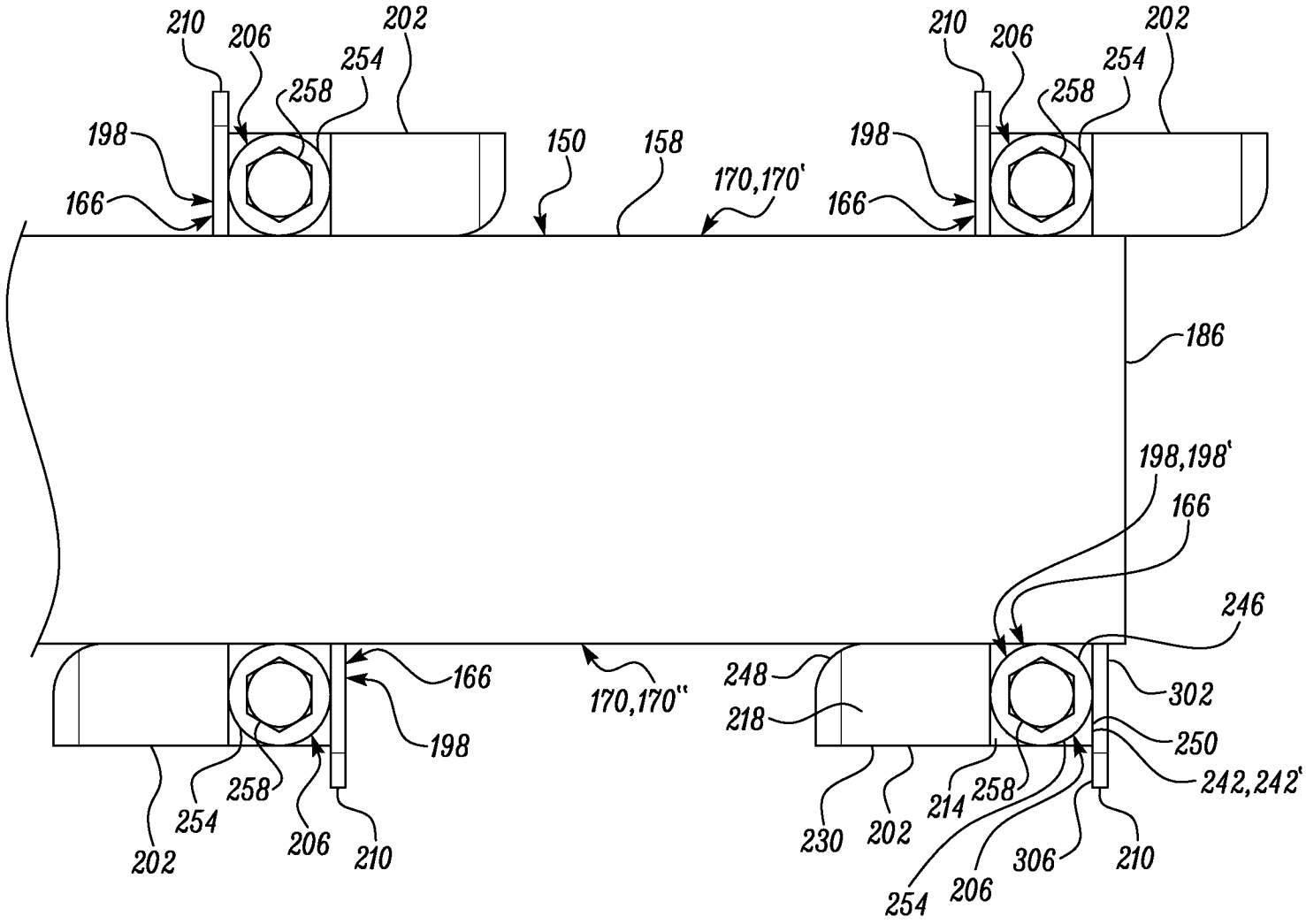
FIGS. 9 and 10 are plan views of a section of the tool, illustrating various conditions of a foot peg of the clasping mechanism of the tool, in accordance with one or more aspects of the present disclosure.

Referring to FIG. 8, and in conjunction with FIGS. 2 through 10, the foot peg 202 may clasp the second end portion 136" of the second rail segment 116", thus enabling the second arrangement 166 to engage with the second end portion 136". Similarly, one or more foot pegs 202 of the clasping mechanisms 198 of the first arrangement 162 may clasp the first end portion 136' of the first rail segment 116', thus enabling the first arrangement 162 to engage with the first end portion 136'. The foot peg 202 may define a block 214 and a clasping edge 218 extending from the block 214. The clasping edge 218 may define a profile configured to be abutted with and clasped to the second end portion 136" of the second rail segment 116". As an example, the clasping edge 218 may define a thickness, T1, relatively close to the block 214 that lessens to a thickness, T2, as the clasping edge 218 extends away from the block 214. In some embodiments, the clasping edge 218 may define an arcuate surface 248 (see FIG. 9).

The block 214 may be integral with the clasping edge 218 and may define a through hole 222 defining a hole axis 226. Further, the block 214 may define an outer side wall 230 (also see FIGS. 2 and 3) extending at least partially around the through hole 222. In some embodiments, the through hole 222 may define internal threads 234 (see FIG. 8). The outer side wall 230 of the foot peg 202 may define a first surface 238 and a second surface 242 (see FIG. 3). The first surface 238 and the second surface 242 may be defined in different planes (e.g., respectively, in a first plane 238' and a second plane 242'), and each of which may be parallel to the hole axis 226. Further, the outer side wall 230 of the block 214 of the foot peg 202 may define a curved transition region 246 (see FIGS. 3, 9, and 10) extending between the first surface 238 and the second surface 242 such that the first surface 238, the second surface 242, and the curved transition region 246, form a continuous uninterrupted surface 250 of the foot peg 202.

The shifting system 206 facilitates a movement of the foot peg 202 to actuate the first arrangement 162 or the second arrangement 166. The shifting system 206 includes a spacer 254 and a fastener 258.

The spacer 254 may be coupled (e.g., fixedly coupled) (e.g., by welding) to the elongated rigid member 158 (e.g., to one of the lateral sides 170 of the elongated rigid member 158). As an example, the spacer 254 may define a cylindrical shape which in turn defines a spacer axis 262, although shapes and profiles other than a cylinder may be contemplated. Also, the spacer 254 may be positioned orthogonally relative to the length, L, of the elongated rigid member 158. The spacer 254 may also define a first spacer axial end 266 and a second spacer axial end 270 opposite to the first spacer axial end 266. The spacer 254 may define a through-bore 274 around the spacer axis 262, and the through-bore 274 may extend from the first spacer axial end 266 to the second spacer axial end 270. According to an aspect of the present disclosure, the through-bore 274 may define a smooth internal peripheral surface 278 with no threads.

The fastener 258 may be received into the through-bore 274 to pass through the through-bore 274. The fastener 258 may be freely rotatable with respect to the through-bore 274. The fastener 258 may define a head 280, a shank 282 extending from the head 280, and a longitudinal axis 286 which may pass through both the head 280 and the shank 282. As an example, the shank 282 may define a threaded portion 290 and a non-threaded portion 294. The non-threaded portion 294 may extend from the head 280 up to the threaded portion 290 and the threaded portion 290 may extend from the non-threaded portion 294 all the way to an end (e.g., a shank end 298) of the shank 282. In an assembly of the fastener 258 to the spacer 254, the head 280 of the fastener 258 may abut or be in contact with the first spacer axial end 266 and one portion (e.g., non-threaded portion 294) of the shank 282 may be accommodated within the through-bore 274, while the other portion (e.g., threaded portion 290) may be disposed outside the through-bore 274, such that the shank end 298 may be disposed away from the second spacer axial end 270. Also, in assembly of the fastener 258 with the spacer 254, the longitudinal axis 286 may be aligned with the spacer axis 262.

Further, the shank 282 of the fastener 258 may be received into the through hole 222 of the foot peg 202 and the threaded portion 290 of the shank 282, disposed outside of the second spacer axial end 270, may be threadably coupled with the internal threads 234 formed in the through hole 222 of the foot peg 202. Effectively, the fastener 258 may be threadably coupled to the foot peg 202, and the foot peg 202 may be angularly rotatable about the longitudinal axis 286 of the fastener 258. When the fastener 258 is rotated with respect to the foot peg 202, the head 280 of the fastener 258 may abut against the spacer 254 (i.e., the first spacer axial end 266 of the spacer 254) and the foot peg 202 may move towards the spacer 254 and thus the elongated rigid member 158. Because the foot peg 202 may be clasped with the first end portion 136' or the second end portion 136", during the alignment process, a movement of the foot peg 202 may urge and cause the first end portion 136' of the first rail segment 116' or the second end portion 136" of the second rail segment 116" to move towards the elongated rigid member 158.

The stopper 210 may be fixedly coupled to the elongated rigid member 158. In other words, the stopper 210 may be immovably coupled with respect to the elongated rigid member 158. The stopper 210 may selectively abut with the first surface 238 and the second surface 242 to restrict a rotation of the foot peg 202 about the longitudinal axis 286 (or the spacer axis 262) within an angular threshold range, AR (see through the cutout provided in FIG. 10). An angle swept by the foot peg 202 across the angular threshold range, AR, may also be equal or correspond to an angle defined between the first surface 238 and the second surface 242. In some embodiments, the stopper 210 may include a plate 302 defining a flat face 306 that may abut with the first surface 238 and the second surface 242 in a selective manner.

According to some embodiments, when the foot peg 202 is at one angular limit of the angular threshold range, AR, the stopper 210 may be abutted with the first surface 238 and the foot peg 202 may be at a first condition (see clasping mechanism 198', FIGS. 7 and 10) to engage the second end portion 136". Conversely, when the foot peg 202 is at another angular limit of the angular threshold range, AR, the stopper 210 may be abutted with the second surface 242 and the foot peg 202 may be at a second condition (see clasping mechanism 198', FIGS. 8 and 9). When foot pegs 202 of all clasping mechanisms 198 are in the second condition, they clear a path, P, P', (see FIG. 4) for the first end portion 136' and/or the second end portion 136" to be either brought into or be removed from the overlapping state with respect to the elongated rigid member 158. In some exemplary embodiments, the angular threshold range, AR, may be defined between 80 to 100 degrees of an angular movement of the foot peg 202 about the longitudinal axis 286.

Given that there may be multiple clasping mechanisms (such as the clasping mechanism 198') as part of each of the first arrangement 162 and the second arrangement 166, the clasping mechanisms 198 of the first arrangement 162 may be arranged on the first part 174 and the clasping mechanisms 198 of the second arrangement 166 may be arranged on the second part 182. Moreover, the clasping mechanisms 198 of the first arrangement 162 may be arranged on opposing lateral sides 170 of the first part 174 of the elongated rigid member 158 and the clasping mechanisms 198 of the second arrangement 166 may be arranged on opposing lateral sides 170 of the second part 182 of the elongated rigid member 158.

INDUSTRIAL APPLICABILITY

Referring to FIG. 1, during operations, as the first rail segment 116' may be mounted atop the post ends 132 of the first post 128' and the second post 128" and the second rail segment 116" may be mounted atop the post ends 132 of the third post 128'" and the fourth post 128"", both the first end portion 136' and the second end portion 136" may be in the sag state and thus may be non-aligned with respect to each other. To align the first end portion 136' with the second end portion 136" and thus also attain alignment and connection between the first rail segment 116' and the second rail segment 116", an operator may bring forth the tool 150 and position the tool 150 atop the first rail segment 116' and the second rail segment 116" in such a manner that the first part 174 of the elongated rigid member 158 may overlap the first end portion 136' of the first rail segment 116' and the second part 182 of the elongated rigid member 158 may overlap the second end portion 136" of the second rail segment 116".

Referring to FIGS. 2 through 8, while positioning the tool 150 atop the first rail segment 116' and the second rail segment 116", the operator may ensure that the foot pegs 202 of each of the clasping mechanisms 198 of the first arrangement 162 and the second arrangement 166 are in the second condition (e.g., see FIGS. 4 and 8) such that the path, P, for the first end portion 136' and the second end portion 136" to be brought into the overlapping state with respect to the elongated rigid member 158 is clear. It may be noted that in the overlapping state, the elongated rigid member 158 is aligned with each of the first rail segment 116' and the second rail segment 116" such that the first part 174 of the elongated rigid member 158 is disposed along (i.e., generally along) a first extension, E1, of the first rail segment 116' and the second part 182 of the elongated rigid member 158 is disposed along (i.e., generally along) a second extension, E2, of the second rail segment 116". The term 'generally' is used to account for the sag state of the first end portion 136' and the second end portion 136".

Figure 10:
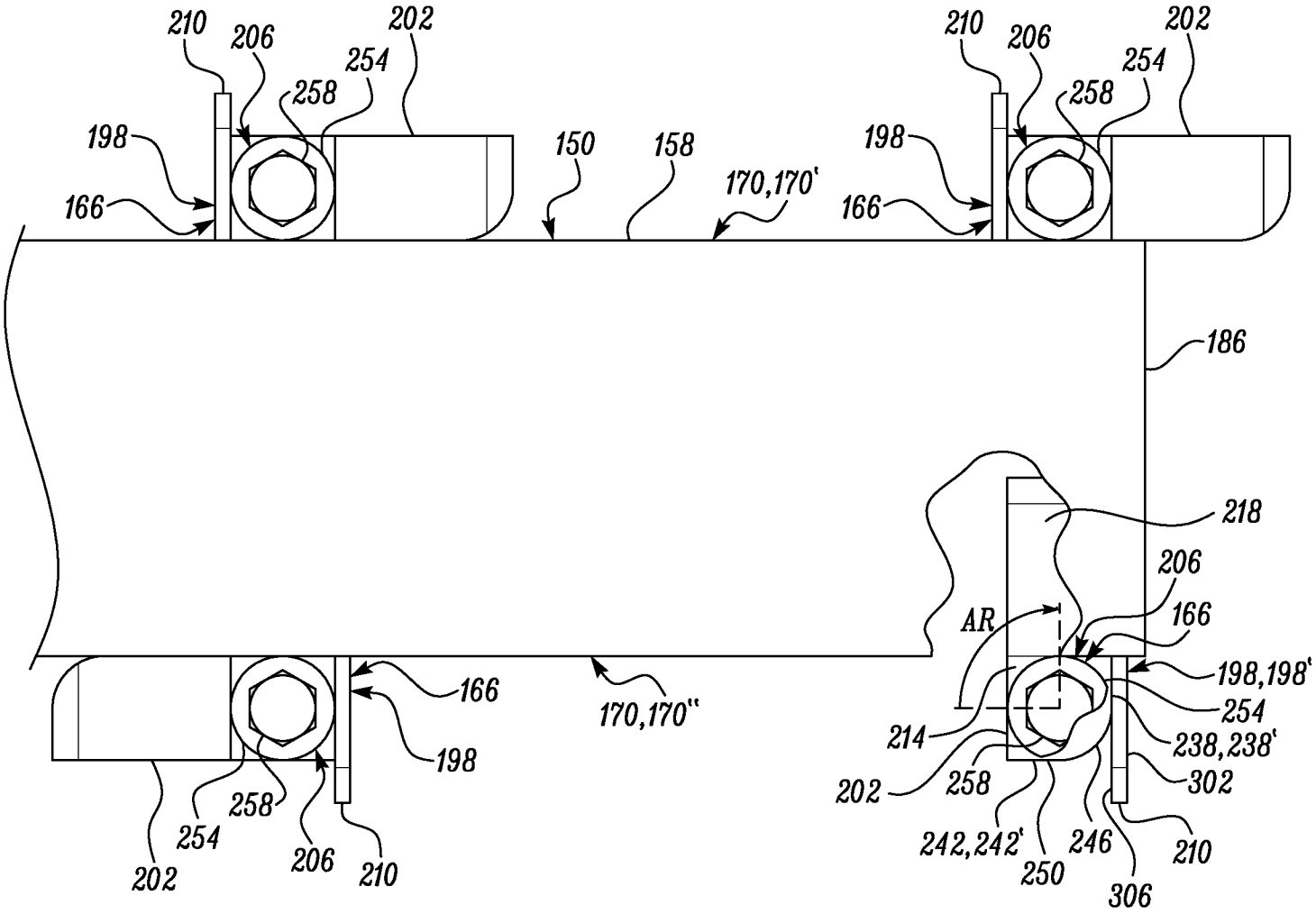

Once the elongated rigid member 158 is positioned in the overlapping state with respect to each of the first rail segment 116' and the second rail segment 116", the operator may turn the foot pegs 202 of each of the clasping mechanisms 198 of the first arrangement 162 and the second arrangement 166 into the first condition (see foot pegs 202 in FIG. 7) (also see foot peg 202 of the clasping mechanism 198' in FIG. 10). In so doing, the foot pegs 202 of the clasping mechanisms 198 of the first arrangement 162 can clasp the first end portion 136' of the first rail segment 116' and the foot pegs 202 of the clasping mechanisms 198 of the second arrangement 166 can clasp the second end portion 136" of the second rail segment 116". Therefore, the first end portion 136' of the first rail segment 116' is engaged by using the first arrangement 162 and the second end portion 136" of the second rail segment 116" is engaged by using the second arrangement 166. With regard to each of the foot pegs 202 of the first arrangement 162 and the second arrangement 166, as the foot pegs 202 move between the first condition and the second condition, the arcuate surface 248 of the foot pegs 202 may interact with the first end portion 136' and/or second end portion 136", while the curved transition region 246 of the foot pegs 202 may interact with the stopper 210. In that manner, both the curved transition region 246 and the arcuate surface 248 may aid in the movement of the foot peg 202 between the first condition and the second condition.

According to an embodiment, a method by which the foot pegs 202 may be turned to clasp the first end portion 136' and the second end portion 136" may include sequentially activating the clasping mechanisms 198 (including turning the corresponding foot pegs 202 from the second condition to the first condition) of the first arrangement 162 arranged on the first part from the first end 178 towards the interface 190. In so doing, the first arrangement 162 is actuated to urge the first rail segment 116' towards the elongated rigid member 158. The method may also include sequentially activating the clasping mechanisms 198 (including turning the corresponding foot pegs 202 from the second condition to the first condition) of the second arrangement 166 arranged on the second part 182 from the second end 186 towards the interface 190. In that manner, the second arrangement 166 is also actuated to urge the second rail segment 116" towards the elongated rigid member 158.

Once the foot pegs 202 are turned to the first condition to engage the first end portion 136' and the second end portion 136", and as part of the actuation of the first arrangement 162 and the second arrangement 166, the operator may turn (e.g., in a clockwise manner) (e.g., sequentially from the first end 178 towards the interface 190) the fasteners 258 of the clasping mechanisms 198 of the first arrangement 162 such that the first end portion 136' may be urged towards the elongated rigid member 158. The operator may also turn (e.g., in a clockwise manner) (e.g., sequentially from the second end 186 towards the interface 190) the fasteners 258 of the clasping mechanisms 198 of the second arrangement 166 such that the second end portion 136" may also be urged towards the elongated rigid member 158. In some embodiments, a turning induced to the fasteners 258 may cause the corresponding foot pegs 202 to also rotate and move (e.g., automatically rotate and move owing to the threadable connection of the foot pegs 202 with the fasteners 258) to the first condition (e.g., see FIGS. 6 and 7).

The fasteners 258 of the clasping mechanisms 198 of both the first arrangement 162 and the second arrangement 166 may be turned until the first end portion 136' and the second end portion 136" are raised and either are abutted to the elongated rigid member 158 or define respective clearances, C1 and C2, with respect to the elongated rigid member 158 which may become equal to each other. The abutment or the equal clearances ensure that the first end portion 136' (or the first rail segment 116') has fallen in alignment with the second end portion 136" (or the second rail segment 116"). At this point, the foot pegs 202 may be tightly clasped with the first end portion 136' and the second end portion 136". When the clearances, C1 and C2, become equal to each other, said clearances, C1 and C2, may correspond to a common consistent clearance defined by the elongated rigid member 158 with the first part 174 and the second part 182 throughout the length of the first part 174 and the second part 182.

In that manner, once the first end portion 136' (and/or the first rail segment 116') and the second end portion 136" (and/or the second rail segment 116") are aligned, the operator may use a connection plate (not shown) to connect the first end portion 136' with the second end portion 136"—e.g., the connection plate may be positioned in part over the first end portion 136' and in part over the second end portion 136", and then one or more fastening elements (not shown) may be driven into the connection plate and the assemblage of the first end portion 136' and the second end portion 136" such that the connection plate can be connected (e.g., immovably connected) to each of the first end portion 136' and the second end portion 136", in turn connecting (e.g., rigidly connecting and reinforcing) the first rail segment 116' with the second rail segment 116" and thus forming a rail portion of the rail line 108.

After the connection is complete, the operator may turn the fasteners 258 of the clasping mechanisms 198 of the first arrangement 162 and the second arrangement 166 in reverse (e.g., in a counter clockwise direction) to loosen the foot pegs 202. Once the foot pegs 202 are loosened by the turning of the fasteners 258, each foot peg 202 may be moved to the second condition (see FIG. 8). In some embodiments, the turning induced to the fasteners 258 may cause the corresponding foot pegs 202 to also rotate and move (e.g., automatically rotate and move owing to the threadable connection of the foot pegs 202 with the fasteners 258) to the second condition (see FIG. 8). As the foot pegs 202 move to the second condition, they may clear the path, P', (see FIG. 4) for the first end portion 136' and the second end portion 136" to be removed from the overlapping state with respect to the elongated rigid member 158, and thus the tool 150 may be lifted and moved away from the rail portion.

It may be understandable from the above description that the tool 150 provides for an easy, inexpensive, and a reliable solution, to align the first rail segment 116' with the second rail segment 116" of the rail line 108, and the same may be performable by operators with basic or minimum skill. Also, the tool 150 may be applicable at various worksites that include a rail line. Moreover, the tool 150 is easy to use and is relatively compact for transportation and handling. Furthermore, the tool 150 is simple in construction and requires no parts which are complex or cumbersome to manufacture and/or assemble.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A tool for aligning a first rail segment with a second rail segment, the tool comprising:

an elongated rigid member configured to be positioned in an overlapping state with respect to each of the first rail segment and the second rail segment;

a first arrangement configured to engage a first end portion of the first rail segment and be actuated to urge the first end portion towards the elongated rigid member; and a second arrangement configured to engage a second end portion of the second rail segment and be actuated to urge the second end portion towards the elongated rigid member, wherein when each of the first end portion and the second end portion is urged towards the elongated rigid member, the first rail segment and the second rail segment adjoin and fall in alignment with each other to be connected together and form a contiguous rail portion of a rail line.

2. The tool of claim 1, wherein each of the first arrangement and the second arrangement includes one or more clasping mechanisms, each clasping mechanism of the one or more clasping mechanisms including:

a foot peg to clasp the first end portion or the second end portion respectively of the first rail segment or the second rail segment, enabling the first arrangement or the second arrangement to correspondingly engage with the first end portion or the second end portion.

3. The tool of claim 2, wherein each clasping mechanism further includes a shifting system to move the foot peg to actuate the first arrangement or the second arrangement, the shifting system including:

a spacer fixedly coupled to the elongated rigid member and defining a through-bore; and a fastener passing through and being freely rotatable with respect to the through-bore, the fastener being threadably coupled to the foot peg, wherein when the fastener is rotated with respect to the foot peg, a head of the fastener abuts against the spacer and the foot peg moves towards the elongated rigid member to urge the first end portion or the second end portion towards the elongated rigid member.

4. The tool of claim 3, wherein the foot peg is angularly rotatable about a longitudinal axis of the fastener, the foot peg defines a first surface and a second surface and each clasping mechanism includes a stopper to selectively abut with the first surface and the second surface to restrict a rotation of the foot peg about the longitudinal axis within an angular threshold range.

5. The tool of claim 4, wherein when the foot peg is at one angular limit of the angular threshold range, the stopper is abutted with the first surface and the foot peg is at a first condition to engage the first end portion or the second end portion; and when the foot peg is at another angular limit of the angular threshold range, the stopper is abutted with the second surface and the foot peg is at a second condition to clear a path for the first end portion or the second end portion to be either brought into or be removed from the overlapping state with respect to the elongated rigid member.

6. The tool of claim 4, wherein the foot peg defines a curved transition region extending between the first surface and the second surface such that the first surface, the second surface, and the curved transition region, forms a continuous uninterrupted surface.

7. The tool of claim 4, wherein the stopper is immovably coupled with respect to the elongated rigid member and includes a flat face to abut with the first surface and the second surface.

8. The tool of claim 2, wherein the elongated rigid member defines a first part and a second part away from the first part; and the one or more clasping mechanisms of the first arrangement corresponds to a plurality of clasping mechanisms arranged on opposing lateral sides of the first part of the elongated rigid member.

9. The tool of claim 2, wherein the elongated rigid member defines a first part and a second part away from the first part; and the one or more clasping mechanisms of the second arrangement corresponds to a plurality of clasping mechanisms arranged on opposing lateral sides of the second part of the elongated rigid member.

10. The tool of claim 6, wherein in the overlapping state, the elongated rigid member is aligned with each of the first rail segment and the second rail segment such that a first part of the elongated rigid member is disposed along a first extension of the first rail segment and a second part of the elongated rigid member is disposed along a second extension of the second rail segment.

11. A method for aligning a first rail segment with a second rail segment, the method comprising:

positioning an elongated rigid member in an overlapping state with respect to each of the first rail segment and the second rail segment;

engaging a first end portion of the first rail segment by using a first arrangement and actuating the first arrangement to urge the first end portion towards the elongated rigid member; and engaging a second end portion of the second rail segment by using a second arrangement and actuating the second arrangement to urge the second end portion towards the elongated rigid member;

wherein when each of the first end portion and the second end portion is urged towards the elongated rigid member, the first rail segment and the second rail segment adjoin and fall in alignment with each other to be connected together and form a contiguous rail portion of a rail line.

12. The method of claim 11, wherein each of the first arrangement and the second arrangement includes one or more clasping mechanisms, each clasping mechanism of the one or more clasping mechanisms including:

a foot peg to clasp the first end portion or the second end portion respectively of the first rail segment or the second rail segment, enabling the first arrangement or the second arrangement to correspondingly engage with the first end portion or the second end portion.

13. The method of claim 12, wherein each clasping mechanism further includes a shifting system to move the foot peg to actuate the first arrangement or the second arrangement, the shifting system including:

a spacer fixedly coupled to the elongated rigid member and defining a through-bore; and a fastener passing through and being freely rotatable with respect to the through-bore, the fastener being threadably coupled to the foot peg, the method further including:

rotating the fastener with respect to the foot peg such that a head of the fastener abuts against the spacer and the foot peg moves towards the elongated rigid member to urge the first end portion or the second end portion towards the elongated rigid member.

14. The method of claim 13, wherein the foot peg is angularly rotatable about a longitudinal axis of the fastener, the foot peg defines a first surface and a second surface and each clasping mechanism includes a stopper to selectively abut with the first surface and the second surface to restrict a rotation of the foot peg about the longitudinal axis within an angular threshold range.

15. The method of claim 14, wherein when the foot peg is at one angular limit of the angular threshold range, the stopper is abutted with the first surface and the foot peg is at a first condition to engage the first end portion or the second end portion; and when the foot peg is at another angular limit of the angular threshold range, the stopper is abutted with the second surface and the foot peg is at a second condition to clear a path for the first end portion or the second end portion to be either brought into or be removed from the overlapping state with respect to the elongated rigid member.

16. The method of claim 14, wherein the foot peg defines a curved transition region extending between the first surface and the second surface such that the first surface, the second surface, and the curved transition region, forms a continuous uninterrupted surface.

17. The method of claim 14, wherein the stopper is immovably coupled with respect to the elongated rigid member and includes a flat face to abut with the first surface and the second surface.

18. The method of claim 12, wherein the elongated rigid member defines a first part and a second part away from the first part; and the one or more clasping mechanisms of the first arrangement corresponds to a plurality of clasping mechanisms arranged on opposing lateral sides of the first part of the elongated rigid member.

19. The method of claim 12, wherein the elongated rigid member defines a first part and a second part away from the first part; and the one or more clasping mechanisms of the second arrangement corresponds to a plurality of clasping mechanisms arranged on opposing lateral sides of the second part of the elongated rigid member.

20. The method of claim 12, wherein the elongated rigid member defines a first part with a first end, a second part with a second end, and an interface between the first part and the second part, the second part is away from the first part and the second end is disposed opposite to the first end; and the one or more clasping mechanisms of the first arrangement corresponds to a plurality of clasping mechanisms arranged on the first part and the one or more clasping mechanisms of the second arrangement corresponds to a plurality of clasping mechanisms arranged on the second part, the method including:

sequentially activating the plurality of clasping mechanisms arranged on the first part from the first end towards the interface to actuate the first arrangement to urge the first rail segment towards the elongated rigid member, and sequentially activating the plurality of clasping mechanisms arranged on the second part from the second end towards the interface to actuate the second arrangement to urge the second rail segment towards the elongated rigid member.

* * * * *